US007264488B2

(12) United States Patent
Harper, Jr.

(10) Patent No.: US 7,264,488 B2
(45) Date of Patent: Sep. 4, 2007

(54) PICKUP CAP FOR ELECTRICAL CONNECTOR

(75) Inventor: Donald K. Harper, Jr., Camp Hill, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/324,836

(22) Filed: Jan. 3, 2006

(65) Prior Publication Data

US 2007/0155205 A1 Jul. 5, 2007

(51) Int. Cl.
*H01R 13/44* (2006.01)

(52) U.S. Cl. ..... 439/135

(58) Field of Classification Search ..... 439/135, 439/940, 342, 41

See application file for complete search history.

(56) References Cited

U.S. PATENT DOCUMENTS

| | | | | |
|---|---|---|---|---|
| 5,508,628 | A | 4/1996 | Pfaff | 324/755 |
| 5,586,008 | A | 12/1996 | Kozel et al. | 361/743 |
| 5,688,133 | A | 11/1997 | Ikesugi et al. | 439/135 |
| 5,722,848 | A * | 3/1998 | Lai et al. | 439/342 |
| 5,731,958 | A | 3/1998 | Kozel | 361/743 |
| 5,746,611 | A * | 5/1998 | Brown et al. | 439/135 |
| 5,827,090 | A | 10/1998 | Knighton | 439/571 |
| 5,833,471 | A | 11/1998 | Selna | 439/73 |
| 5,860,815 | A | 1/1999 | Feldman et al. | 439/79 |
| 5,899,760 | A | 5/1999 | Ho et al. | 439/135 |
| 6,049,464 | A | 4/2000 | Garbelli et al. | 361/760 |
| 6,155,848 | A * | 12/2000 | Lin | 439/135 |
| 6,186,816 | B1 * | 2/2001 | Lu et al. | 439/342 |
| 6,313,999 | B1 | 11/2001 | Fratti et al. | 361/774 |
| 6,392,887 | B1 | 5/2002 | Day et al. | 361/704 |
| 6,413,111 | B1 | 7/2002 | Pickels et al. | 439/342 |
| 6,475,023 | B2 | 11/2002 | Carneling | 439/488 |
| 6,478,588 | B1 * | 11/2002 | Howell et al. | 439/135 |
| 6,533,592 | B1 | 3/2003 | Chen et al. | 439/135 |
| 6,561,825 | B1 * | 5/2003 | McHugh et al. | 439/135 |
| 6,619,974 | B1 * | 9/2003 | Hou et al. | 439/342 |
| 6,655,970 | B2 * | 12/2003 | Tsai | 439/135 |
| 6,705,883 | B1 * | 3/2004 | Ku | 439/342 |
| 6,753,474 | B2 | 6/2004 | Trout | 174/66 |
| 6,783,369 | B2 | 8/2004 | Zhang | 439/41 |
| 6,805,278 | B1 | 10/2004 | Olson et al. | 228/180.22 |
| 6,945,799 | B2 * | 9/2005 | Huang | 439/135 |
| 7,014,488 | B2 * | 3/2006 | Stone | 439/331 |
| 7,037,116 | B1 * | 5/2006 | Liao et al. | 439/71 |
| 2003/0027439 | A1 | 2/2003 | Johnescu et al. | 439/74 |
| 2004/0097104 | A1 | 5/2004 | Zhang | 439/41 |
| 2004/0175974 | A1 * | 9/2004 | Ma et al. | 439/135 |
| 2004/0198082 | A1 | 10/2004 | Zaderej et al. | 439/83 |
| 2004/0248431 | A1 * | 12/2004 | Liao et al. | 439/41 |
| 2004/0248442 | A1 | 12/2004 | Huang | 439/135 |

(Continued)

*Primary Examiner*—Tulsidas C. Patel
*Assistant Examiner*—Vladimir Imas
(74) *Attorney, Agent, or Firm*—Woodcock Washburn LLP

(57) ABSTRACT

An electrical assembly comprises an electrical connector, and an improved pickup cap that is provided with a surface area configuration that has the potential to impart a more even temperature distribution across the ball grid array during reflow. Some embodiments of the pickup cap, when connected to the electrical connector, cover the sides of the electrical connector, but do not cover the central portion of the electrical connector. Such a configuration of pickup cap surface areas has the potential to provide a more even temperature distribution across the grid of solder balls during reflow of the solder balls.

20 Claims, 4 Drawing Sheets

U.S. PATENT DOCUMENTS

2004/0266233 A1 12/2004 Huang ..... 439/135
2004/0266247 A1* 12/2004 Liao ..... 439/342
2005/0032397 A1 2/2005 Huang ..... 439/41
2005/0064753 A1* 3/2005 Ma ..... 439/331

* cited by examiner

PICKUP CAP FOR ELECTRICAL CONNECTOR

FIELD OF THE INVENTION

The invention relates to caps for picking up electrical connectors, typically via a vacuum suction device.

BACKGROUND OF THE INVENTION

In the manufacture of computers and other electronic devices and assemblies, connectors must often be picked up and moved from one location to another. For example, a connector may be picked up and placed on a printed circuit board, then soldered to the printed circuit board. Large connectors are typically picked up with a clip, and small connectors are typically picked up with a vacuum suction device. Such small connectors typically include mini board-to-board connectors, CPU socket connectors, and the like. The vacuum suction device creates a vacuum against a smooth area on the connector. This vacuum provides a force so that the vacuum suction device can pick up the connector and move it to an appropriate position for soldering, connecting, etc.

Many connectors do not have a very large smooth surface area and thus are not able to be directly picked up with a vacuum suction device. As such, pickup caps are often used to facilitate picking up and moving such connectors. The pickup caps connect to the electrical connector and provide a smooth area for the vacuum suction device to pickup the cap-connector assembly. Once the connector has been moved into an appropriate position and soldered (or otherwise connected) to the printed circuit board (or other electronic assembly), the cap can be removed.

A conventional pickup cap includes a smooth solid surface area in the center of the pickup cap to allow the vacuum suction device to pickup the cap. Providing the smooth surface in the center of the cap allows the vacuum suction device to pick up the cap with a single suction head and to keep the cap-connector assembly balanced during movement. This arrangement of a center smooth surface on a pickup cap, however, may have disadvantages which have previously been unidentified.

SUMMARY OF THE INVENTION

In the case of soldering a ball grid array type connector (e.g., a connector having a grid of solder balls) to a printed circuit board (or other electronic assembly), the surface area configuration of the pickup cap may affect the temperature distribution across the ball grid array, resulting in less than optimal soldering conditions during soldering or reflow.

An improved pickup cap may be provided with a surface area configuration that may impart a more even temperature distribution across the ball grid array during reflow. The pickup cap, when connected to the electrical connector, may cover the sides of the electrical connector, but not cover the central portion of the electrical connector. Such a configuration of pickup cap surface areas may provide a more even temperature distribution across the grid of solder balls during reflow of the solder balls. The pickup cap may also form slits to impart a substantially even temperature distribution across the grid of solder balls during reflow.

The pickup cap may include one or more smooth flat areas for access by a vacuum suction device. For example, the pickup cap may include two smooth flat areas on opposite sides of a centrally located opening. The pickup cap may further include a detachable connection mechanism, such as a protrusion, a latch, a recess, a surface for an interference fit, a mechanical engagement, a detent, a spring-loaded device, a thread, and the like, for detachable connection to the electrical connector.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein.

DETAILED DESCRIPTION OF ILLUSTRATIVE EMBODIMENTS

Figure 1:
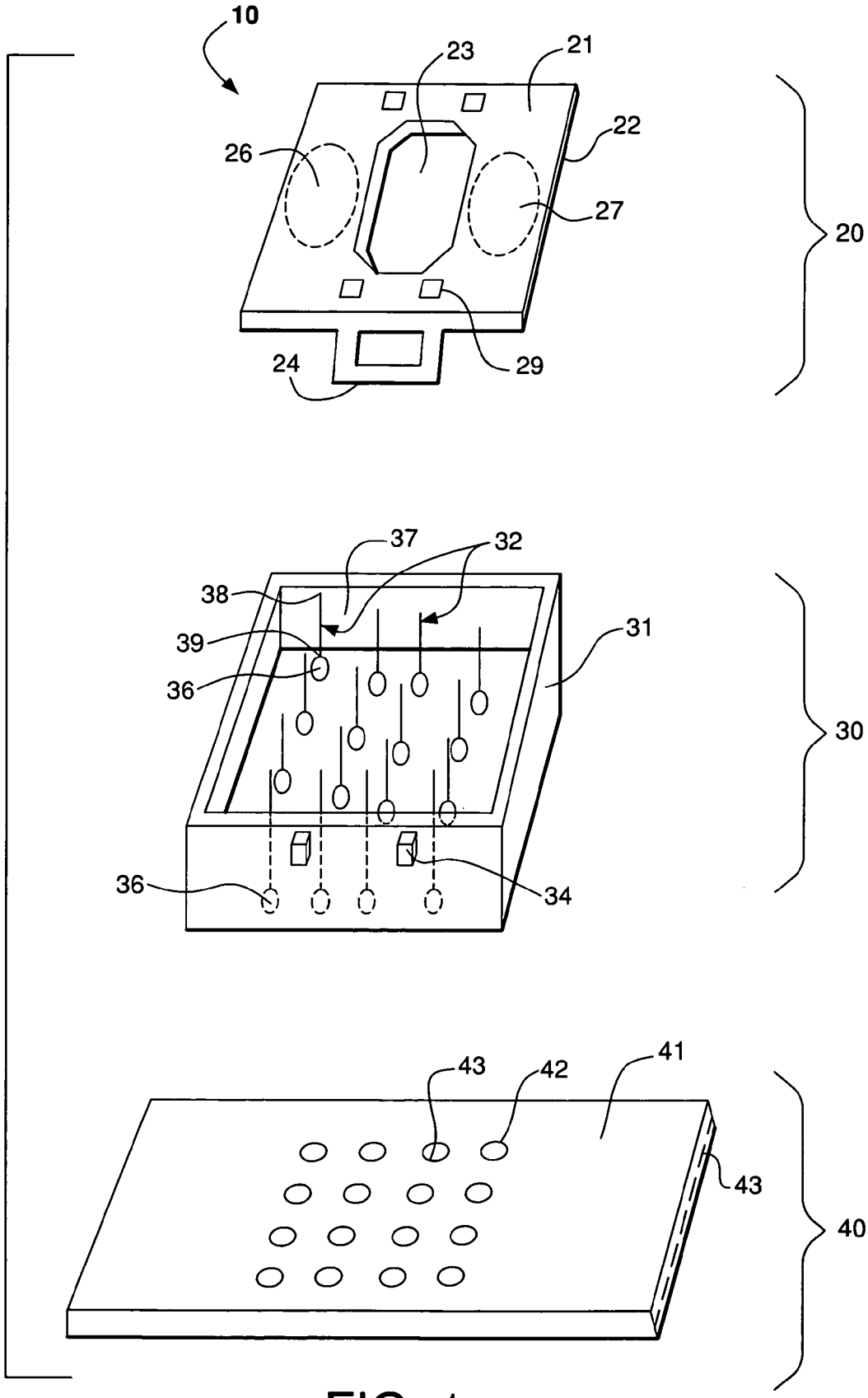
FIG. 1 is a perspective view of an illustrative pickup cap, electrical connector, and printed circuit board, in accordance with an embodiment of the invention.

Certain terminology may be used in the following description for convenience only and is not considered to be limiting. For example, the words "left," "right," "upper," "lower," "horizontal," and "vertical" designate directions in the drawings to which reference is made. Likewise, the words "inwardly" and "outwardly" are directions toward and away from, respectively, the geometric center of the referenced object. The terminology includes the words above specifically mentioned, derivatives thereof, and words of similar import.

As shown in FIG. 1, electrical connection system 10 may include a pickup cap 20, an electrical connector 30, and a printed circuit board 40. Pickup cap 20 may detachably connect to electrical connector 30 such that electrical connector 30 can be moved using pickup cap 20. When pickup cap 20 and electrical connector 30 are connected together, connector 30 can be placed (via pickup cap 20) on printed circuit board 40 for appropriate connection (e.g., soldering) to printed circuit board 40. Once electrical connector 30 is appropriately connected to printed circuit board 40, pickup cap 20 can be removed from connector 30 so that further assembly can be performed, etc.

As shown in FIG. 1, printed circuit board 40 may include a substantially planar substrate 41 that defines holes 42. Printed circuit board 40 may further include conductors 43 within or on substrate 41. Holes 42 typically expose conductors 43 in printed circuit board 40, thus allowing electrical communication with various conductors 43 in printed circuit board 40. Holes 42 can receive solder balls (or contacts, etc.) from a ball grid array and holes 42 typically align with solder balls (or contacts, etc.) of electrical connector 30. Connection of electrical connector 30 to holes 42 of printed circuit board 40 allows electrical communication between the contacts 32 of electrical connector 30 and conductors 43 of printed circuit board 40. Printed circuit board 40 can be any type of printed circuit board or alternatively, may be any part of an electrical device.

As shown in FIG. 1, electrical connector 30 may include an insulative body 31 that mechanically supports a plurality of conductive contacts 32 (e.g., via an array of rectangular openings, not shown, at the bottom of body 31). Insulative body 31 is typically shaped as a rectangular or square, but may be any shape. Insulative body 31 is typically formed from a dielectric material such as a liquid crystal polymer that can withstand soldering temperatures, but can be formed of any insulative material. Electrical connector 30 may form a space 37 for receiving an electrical part, such as a central processing unit, a mating electrical connector, and the like.

As shown, conductive contacts 32 may each have a first end 39 for electrical communication with printed circuit board 40 and a second end 38 for electrical communication with an electrical part (not shown). Conductive contacts 32 may each have an associated solder ball 36 at the first end 39 of conductive contact 32 forming a plurality of solder balls 36 or an array of solder balls 36 (i.e., a ball grid array). The solder balls 36 may be aligned with the holes 42 of printed circuit board 40. When connector 30 is placed on printed circuit board 40, each solder ball 36 may be soldered to its associated hole 42 of printed circuit board 40 by applying heat in a process known as reflow. In the reflow process, it may be desirable to apply a uniform amount of heat to each solder ball 36. While electrical connector 30 is shown as a ball grid array connector, electrical connector 30 may be any type of electrical connector, such as, a solder type connector, a male-female electrical connector, a ribbon connector, and the like.

Electrical connector 30 may further include a protrusion 34 that mates with latch 24 of pickup cap 20 to provide a detachable connection between electrical connector 30 and pickup cap 20. Alternatively, electrical connector 30 may include a recess (not shown) and pickup cap 20 may include a protrusion (not shown) to provide a detachable connection between electrical connector 30 and pickup cap 20. Further, protrusion 34 may simply engage a horizontal section of latch 24. Moreover, any detachable connection may be used, such as an interference fit, mechanical engagement, detent, spring-loaded device, threads, and the like, between electrical connector 30 and pickup cap 20.

As shown in FIG. 1, pickup cap 20 may comprise a plate 28 that forms an upper surface 21 and a lower surface 22 that define an opening 23 for transmitting heat therethrough. Opening 23 is shown as being generally octagonal in shape, however, opening 23 may be square, circular, rectangular, oval, and the like. Opening 23 is generally located substantially near a central portion of the upper surface 21. When pickup cap 20 is connected to connector 30, opening 23 may align substantially near a central portion of the plurality of solder balls 36. Opening 23 may be located and shaped such that, when pickup cap 20 is connected to electrical connector 30, application of heat to the plurality of solder balls 36 results in uniform solder ball melting. That is, each of the solder balls of the plurality of solder balls 36 melts at substantially the same time and experiences substantially the same amount of reflow. The size and shape of opening 23 may be designed to increase the uniformity of solder ball melt by using commercial heat transfer analysis software, empirical analysis techniques, or the like.

Upper surface 21 and lower surface 22 may form slits 29 to provide more uniform heat distribution across the plurality of solder balls 36 of electrical connector 30. The desired location and size of such slits may be determined using heat transfer analysis software, empirical techniques, and the like.

As shown in FIG. 1, upper surface 21 may further include smooth flat surface areas 26 and 27 such that a vacuum suction device (not shown) can pull suction on areas 26 and 27 to enable moving pickup cap 20. Areas 26 and 27 are shown as being located on opposite sides of opening 23, but could be located in various portions of pickup cap 20. A symmetric orientation of areas 26 and 27 may provide better balance for moving pickup cap 20 via a vacuum suction device. Areas 26 and 27 may be approximately 12 mm wide to accommodate vacuum suction devices (not shown). The distance from the center of area 26 to the center of area 27 may be about 27 mm. Areas 26 and 27, and the distances between them, may have other dimensions. Areas 26 and 27 provide two separate areas for contact by a vacuum suction device (not shown), however, other numbers of areas may be provided. Further, a single suction head or multiple suction heads (not shown) may be used to contact and pull vacuum on pickup cap 20.

As shown, pickup cap 20 may further include latches 24 extending below lower surface 22. Latches 24 may include a recess (or protrusion) (not shown) to mate with a corresponding protrusion 34 (or recess, not shown) of electrical connector 30, thereby detachably connecting electrical connecter 30 to pickup cap 20.

Figure 2:
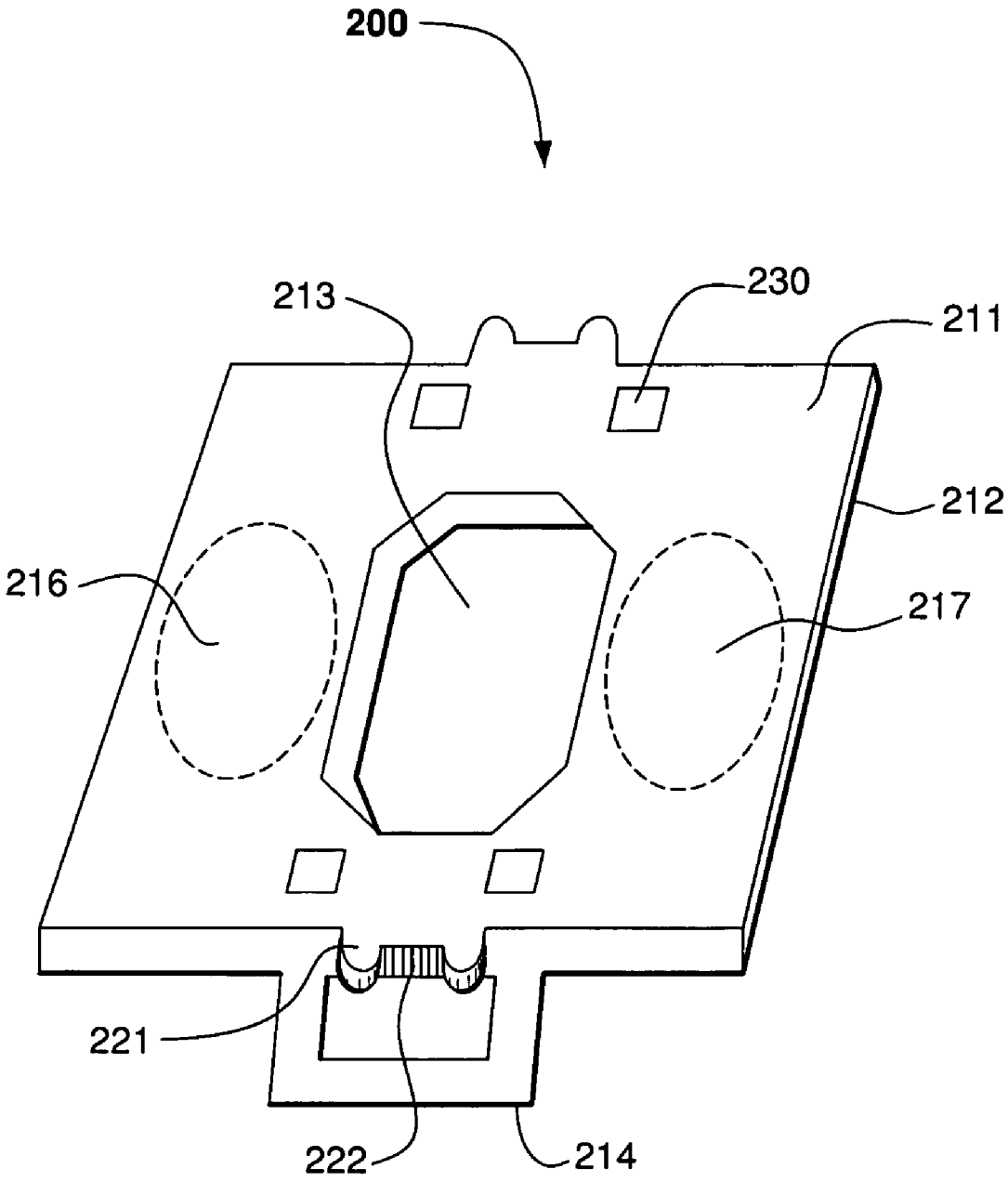
FIG. 2 is a perspective view of an illustrative pickup cap in accordance with an embodiment of the invention.

FIG. 2 shows another illustrative pickup cap 200. As shown, pickup cap 200 may comprise a plate 218 that forms an upper surface 211 and a lower surface 212 that define an opening 213. Opening 213 is shown as being generally octagonal in shape, however, opening 213 may be square, circular, rectangular, oval, and the like. Opening 213 is generally located substantially near a central portion of the upper surface 211. When pickup cap 200 is connected to an electrical connector (e.g., connector 30), opening 213 may align substantially near a central portion of the plurality of solder balls 36 of electrical connector 30. Opening 213 may be located and shaped such that, when pickup cap 200 is connected to electrical connector 30, application of heat to the plurality of solder balls 36 of electrical connector 30 results in uniform solder ball melting. Upper surface 211 may generally be square shaped, for example, to match the shape of space 37 of electrical connector 30. Upper surface 211 may, however, be any shape and may not match the shape of space 37 of electrical connector, as seen in later-described embodiments.

As shown, pickup cap 200 may include latches 214 extending from bottom surface 212. Latches 214 may mate with an electrical connector (e.g., electrical connector 30) to form a detachable connection as described above in connection with FIG. 1. Upper surface 211 and lower surface 212 may form slits 230 that are located proximate to latches 214 provide access to latches 214, such that electrical connector 30 may be disconnected from pickup cap 200 (e.g., to pry latch 214 outwardly and away from the electrical connector). Upper surface 211 and lower surface 212 may form additional slits 230 to provide more uniform heat distribution across the plurality of solder balls 36. The desired location and size of such additional slits may be determined using heat transfer analysis software, empirical techniques, and the like.

As shown in FIG. 2, upper surface 211 may further include smooth flat surface areas 216 and 217 such that a vacuum suction device (not shown) can pull suction on areas 216 and 217 to enable moving pickup cap 200. Areas 216 and 217 may be approximately 12 mm wide to accommodate vacuum suction devices (not shown). The distance from the center of area 216 to the center of area 217 may be about 27 mm. Areas 216 and 217, and the distances between them, may have other dimensions.

As shown, upper surface 211 and lower surface 212 may form an I-shaped extension 221 with ridges 222 formed on the inner portion of I-shaped extension 221. I-shaped extension 221 may be sized to approximate a human finger to facilitate human handling of cap 200.

Figure 3:
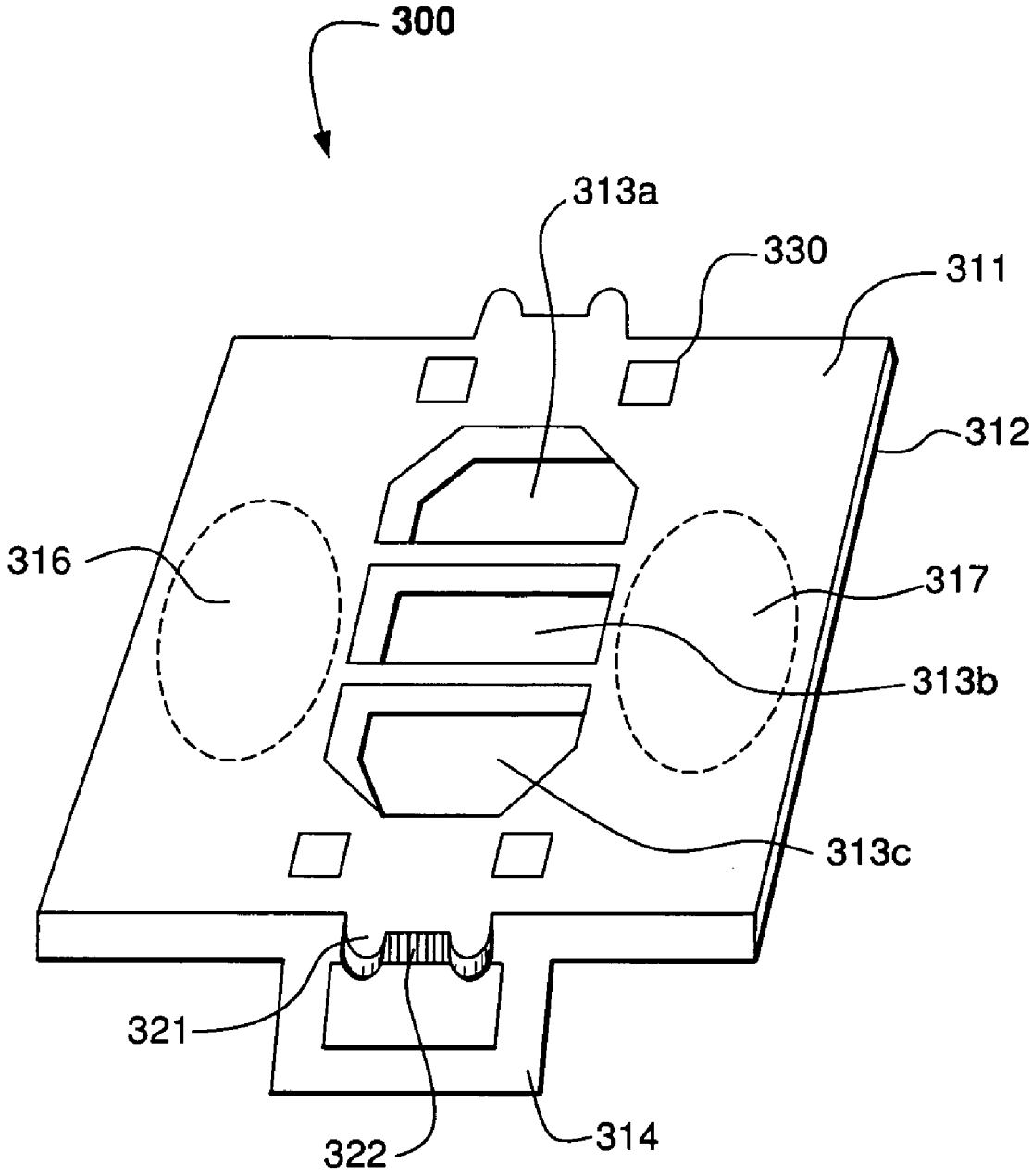
FIG. 3 is a perspective view of an illustrative pickup cap in accordance with an embodiment of the invention.

FIG. 3 shows another illustrative pickup cap 300. As shown, pickup cap 300 may comprise a plate 318 that forms an upper surface 311 and a lower surface 312 that define multiple openings 313*a*, 313*b*, and 313*c*. Openings 313*a*, 313*b*, and 313*c* taken together, are similar in shape to opening 213, except that openings 313*a*, 313*b*, and 313*c* are distinct openings. Openings 313*a*, 313*b*, and 313*c* may generally be located substantially near a central portion of the upper surface 311. When pickup cap 300 is connected to an electrical connector (e.g., connector 30), openings 313*a*, 313*b*, and 313*c* may align substantially near a central portion of the plurality of solder balls 36 of an electrical connector (e.g., connector 30). Openings 313*a*, 313*b*, and 313*c* may be located and shaped such that, when pickup cap 300 is connected to electrical connector 30, application of heat to the plurality of solder balls 36 results in uniform solder ball melting.

As shown, pickup cap 300 may include latches 314 similar to latches 214 described in connection with FIG. 2. Upper surface 311 and lower surface 312 may form slits 330 that provide access to latches 314 similar to slits 230 described in connection with FIG. 2.

As shown in FIG. 3, upper surface 311 may further include smooth flat surface areas 316 and 317 such that a vacuum suction device (not shown) can pull suction on areas 316 and 317 to enable moving pickup cap 300. Areas 316 and 317 may be approximately 12 mm wide to accommodate vacuum suction devices (not shown). Areas 316 and 317 may also be other dimensions.

As shown, upper surface 311 and lower surface 312 may form an I-shaped extension 321 similar to I-shaped extension 221 described in connection with FIG. 2.

Figures 4A, 4B:
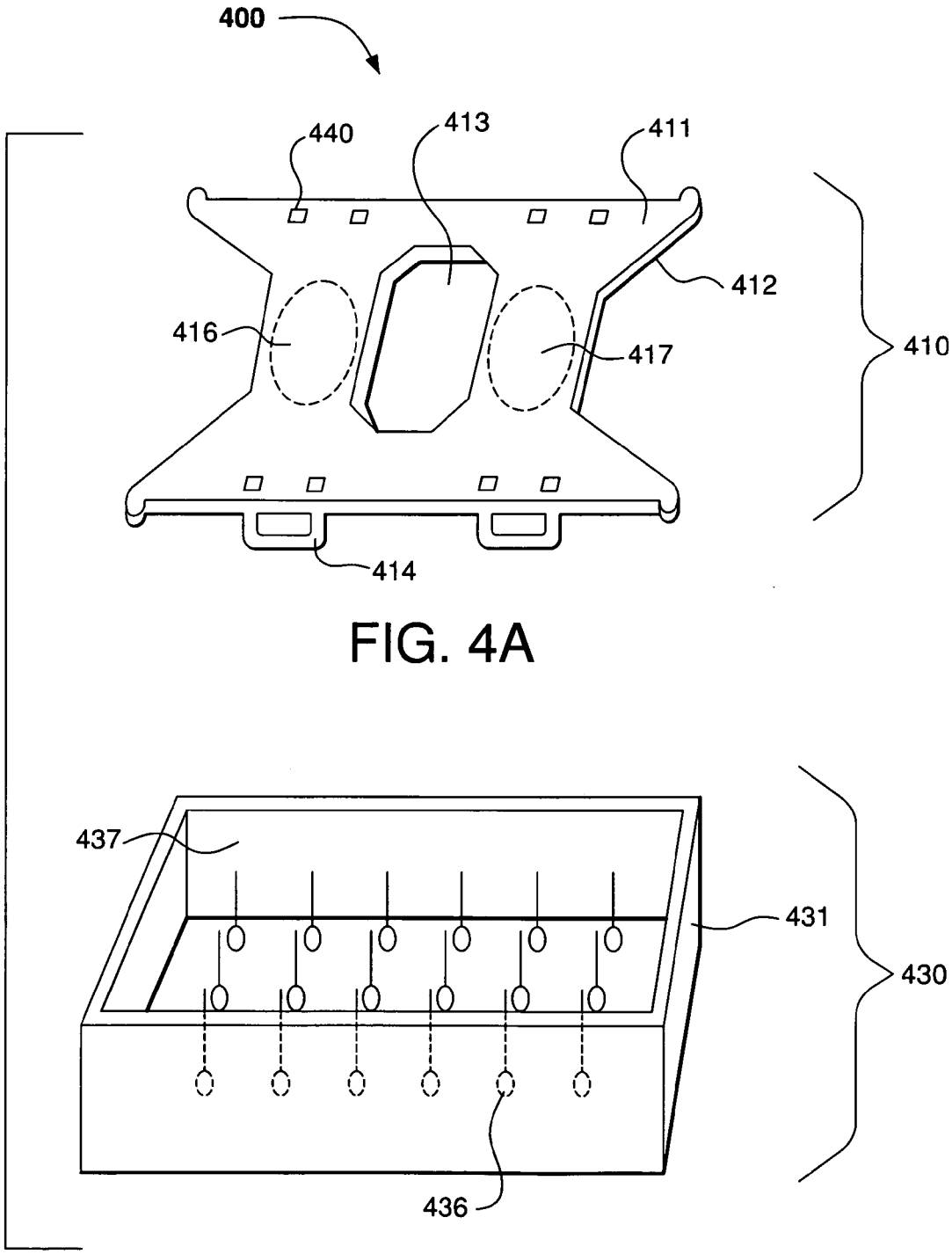
FIG. 4 is a perspective view of an illustrative pickup cap in accordance with an embodiment of the invention.

FIG. 4 shows another illustrative pickup cap 410 in an electrical connection system 400 for detachable connection to electrical connector 430. As shown, pickup cap 410 may comprise a plate 418 that forms an upper surface 411 and a lower surface 412 that define an opening 413. Opening 413 is similar to opening 213 described above in connection with FIG. 2. Opening 413 may be generally located substantially near a central portion of the upper surface 411. When pickup cap 410 is connected to an electrical connector 430, opening 413 may align substantially near a central portion of the plurality of solder balls 436 of electrical connector 430. Opening 413 may be located and shaped such that, when pickup cap 410 is connected to electrical connector 430, application of heat to the plurality of solder balls 436 of the electrical connector 430 results in uniform solder ball melting.

Upper surface 411 may be generally rectangular shaped and not exactly match the space 437 defined by electrical connector 430. Instead the left and right sides of upper surface 411 may not extend all the way to the body 431 of electrical connector 430 (while the top and bottom sides of upper surface 411 may extend all the way to the body 431 of electrical connector 430). Thus, the pickup cap 410 may cover the top and bottom sides of electrical connector 430, but may not cover the left and right sides of electrical connector 430. Various portions of electrical connector 430 may be covered by pickup cover 410 to provide more uniform solder ball melting.

As shown, pickup cap 410 may include latches 414 extending from bottom surface 412. Latches 414 may mate with electrical connector 430 to form a detachable connection as described above in connection with FIG. 1. Upper surface 411 and lower surface 412 may form slits 440 that provide access to latches 414, such that electrical connector 430 may be disconnected from pickup cap 410. Upper surface 411 and lower surface 412 may form additional slits 440 to provide more uniform heat distribution across the plurality of solder balls 436.

As shown in FIG. 4, upper surface 411 may further include smooth flat surface areas 416 and 417 such that a vacuum suction device (not shown) can pull suction on areas 416 and 417 to enable moving pickup cap 410.

Therefore, it can be seen that an improved electrical connector pickup cap is provided that can impart a more even temperature distribution across the ball grid array during soldering or reflow. It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed is:

1. An electrical assembly, comprising:

an electrical connector, comprising:

an insulative body;

an array of conductive contacts having first and second ends and being retained in the insulative body, the array of conductive contacts comprising all of the conductive contacts of the electrical connector; and a first detachable connection mechanism; and a pickup cap, comprising:

a plate defining an upper surface and a lower surface; and a second detachable connection mechanism extending from the lower surface of the pickup cap and detachably connected to the first detachable connection mechanism of the electrical connector;

wherein the upper surface and the lower surface define an opening aligned with a center of the array of conductive contacts of the electrical connector.

2. The electrical assembly as recited in claim 1, wherein the electrical connector further comprises a solder ball at the first end of each of the conductive contacts and the opening is formed to impart a substantially even temperature distribution across the ball grid array during reflow of the solder balls.

3. The electrical assembly as recited in claim 1, wherein the upper surface of the pickup cap forms a smooth flat area.

4. The electrical assembly as recited in claim 1, wherein the upper surface of the pickup cap forms two smooth flat areas on opposite sides of the opening.

5. The electrical assembly as recited in claim 1, wherein the upper surface of the pickup forms a slit proximate the second detachable connection mechanism whereby the slit provides access to the second detachable connection mechanism.

6. The electrical assembly as recited in claim 1, wherein the electrical connector further comprises a solder ball at the first end of each of the conductive contacts forming a grid of solder balls and wherein the upper surface of the pickup forms a slit to impart a substantially even temperature distribution across the grid of solder balls during reflow of the solder balls.

7. A pickup cap for an electrical connector having an array of conductive contacts, the array of conductive contacts including all of the conductive contacts of the electrical connector, the pickup cap comprising:

a plate defining an upper surface and a lower surface; and a detachable connection mechanism extending from the lower surface of the pickup cap and adapted to be detachably connected to the electrical connector;

wherein the upper surface and the lower surface define an opening aligned with a center of the array of conductive contacts of the electrical connector when the pickup cap is connected to the electrical connector.

8. The pickup cap as recited in claim 7, wherein the electrical connector further comprises a solder ball at a first end of each of the conductive contacts forming a grid of solder balls and the opening is formed to impart a substantially even temperature distribution across the grid of solder balls during reflow of the solder balls.

9. The pickup cap as recited in claim 7, wherein the upper surface of the pickup cap forms a smooth flat area.

10. The pickup cap as recited in claim 7, wherein the upper surface of the pickup cap forms at least two smooth flat areas on opposite sides of the opening.

11. The pickup cap as recited in claim 7, wherein the upper surface of the pickup cap forms a slit proximate the detachable connection mechanism whereby the slit provides access to the detachable connection mechanism.

12. The pickup cap as recited in claim 7, wherein the electrical connector further comprises a solder ball at a first end of each of the conductive contacts forming a grid of solder balls and wherein the upper surface of the pickup cap forms a slit to impart a substantially even temperature distribution across the grid of solder balls during reflow of the solder balls.

13. An electrical assembly, comprising:

an electrical connector having at least two sides, a central portion, and an array of conductive contacts each having a first and second end; and a pickup cap detachably connected to the electrical connector that covers the at least two sides of the electrical connector and does not cover the central portion of the electrical connector so that a central portion of the array of conductive contacts is not covered by the cover.

14. The electrical assembly as recited in claim 13, wherein the pickup cap covers each side of the electrical connector.

15. The electrical assembly as recited in claim 13, wherein the electrical connector further comprises:

a solder ball at the first end of each of the conductive contacts forming a grid of solder balls;

and wherein the pickup cap is formed to impart a substantially even temperature distribution across the grid of solder balls during reflow of the solder balls.

16. The electrical assembly as recited in claim 15, wherein the pickup cap comprises a plate defining an upper surface that forms a slit to impart a substantially even temperature distribution across the grid of solder balls during reflow of the solder balls.

17. The electrical assembly as recited in claim 13, wherein the pickup cap comprises a plate defining an upper surface that forms a smooth flat area.

18. The electrical assembly as recited in claim 13, wherein the pickup cap comprises a plate defining an upper surface that forms an opening in a central portion of the pickup cap and forms at least two smooth flat areas on opposite sides of the opening.

19. The electrical assembly as recited in claim 13, wherein the pickup cap further comprises a detachable connection mechanism.

20. The electrical assembly as recited in claim 13, wherein the pickup cap comprises a plate defining an upper surface and a lower surface, the pickup cap further comprises a detachable connection mechanism extending from the lower surface of the pickup cap and wherein the upper surface of the pickup cap forms a slit proximate the detachable connection mechanism whereby the slit provides access to the detachable connection mechanism.

* * * * *